US010187724B2

(12) United States Patent
Tsai

(10) Patent No.: US 10,187,724 B2
(45) Date of Patent: Jan. 22, 2019

(54) DIRECTIONAL SOUND PLAYING SYSTEM AND METHOD

(71) Applicants: NANNING FUGUI PRECISION INDUSTRIAL CO., LTD., Nanning (CN); HON HAI PRECISION INDUSTRY CO., LTD., New Taipei (TW)

(72) Inventor: Hsiao-Jen Tsai, New Taipei (TW)

(73) Assignee: NANNING FUGUI PRECISION INDUSTRIAL CO., LTD., Nanning (CN)

( * ) Notice: Subject to any disclaimer, the term of this patent is extended or adjusted under 35 U.S.C. 154(b) by 0 days.

(21) Appl. No.: 15/434,183

(22) Filed: Feb. 16, 2017

(65) Prior Publication Data

US 2018/0234766 A1 Aug. 16, 2018

(51) Int. Cl.
*H04R 3/12* (2006.01)
*H04R 29/00* (2006.01)

(52) U.S. Cl.
CPC ..... *H04R 3/12* (2013.01); *H04R 29/001* (2013.01)

(58) Field of Classification Search
CPC ..... H04R 3/12; H04R 29/001; H04R 3/00
USPC ..... 381/58, 387, 87, 332, 336, 386
See application file for complete search history.

(56) References Cited

U.S. PATENT DOCUMENTS 9,794,724 B1 * 10/2017 Shintani et al. ..... H04S 7/00
2007/0286433 A1 * 12/2007 Yoshino ..... H04R 3/00 381/32

FOREIGN PATENT DOCUMENTS

EP 2879405 6/2015
TW 201605252 2/2016

* cited by examiner

*Primary Examiner* — Matthew Eason
*Assistant Examiner* — Sabrina Diaz
(74) *Attorney, Agent, or Firm* — ScienBiziP, P.C.

(57) ABSTRACT

A directional sound playing system using ultrasonic sound sources, the ultrasonic sound sources being installed on a surface of a supporting body. The directional sound playing system includes a setting module, a first detecting module, and a driving control module. The setting module sets a distribution position of each of the ultrasonic sound sources on the surface of the supporting body according to the angle of output of each of the ultrasonic sound sources and a requirement angle of a listener. The first detecting module obtains location information of the listener. The driving control module selects and drives one or more ultrasonic sound sources to transmit and direct ultrasonic sound corresponding to the location information of the listener. A directional sound playing method is also provided.

16 Claims, 8 Drawing Sheets

DIRECTIONAL SOUND PLAYING SYSTEM AND METHOD

FIELD

The subject matter herein generally relates to audio production.

BACKGROUND

Ultrasonic loudspeaker does not produce ordinary, audible sound waves with a single, moving, electromagnetic coil and cone. Instead, it generates ultrasound (high-frequency sound waves) with pitches too high to hear for humans. The ultrasonic loudspeaker can direct sound like a spotlight to a precise position where only certain people can hear it. When an audience is not static in one single place, he cannot perceive an ultrasound sound wave from the ultrasonic loudspeaker at any time.

BRIEF DESCRIPTION OF THE DRAWINGS

Implementations of the present technology will now be described, by way of example only, with reference to the attached figures.

DETAILED DESCRIPTION

Figure 1:
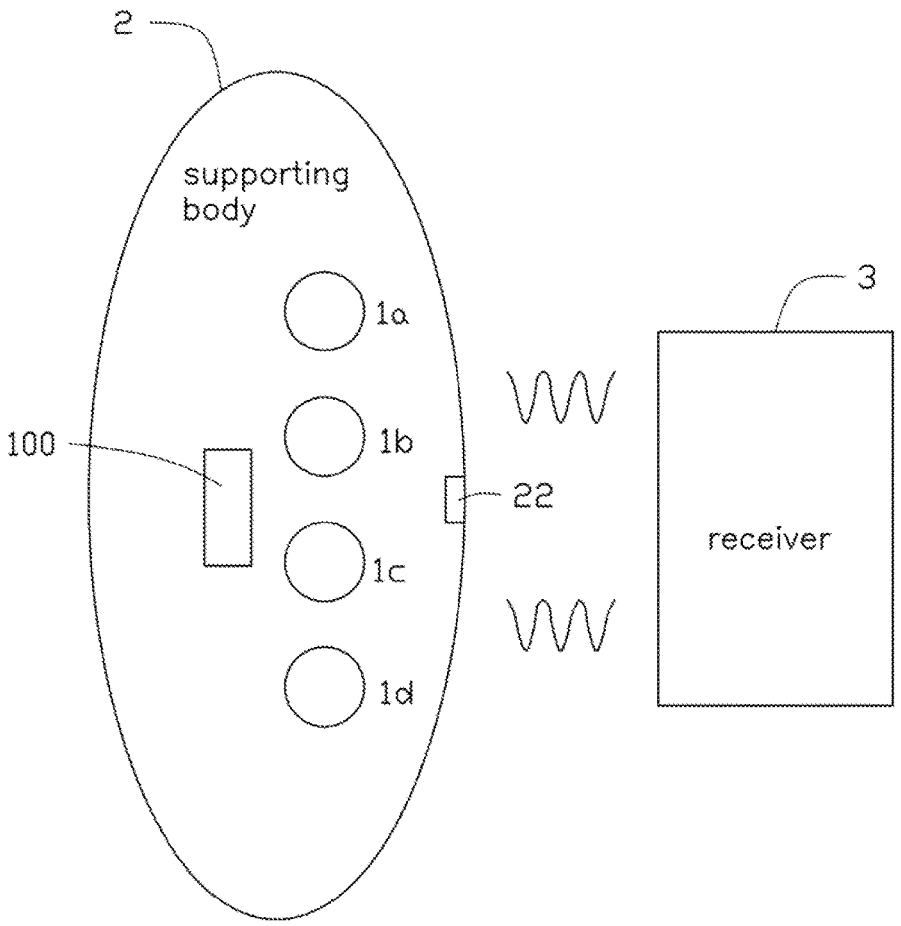
FIG. 1 is a diagram of an exemplary embodiment of a directional sound playing system.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure. It should be noted that references to "an" or "one" exemplary embodiment in this disclosure are not necessarily to the same exemplary embodiment, and such references mean "at least one."

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series, and the like.

FIG. 1 illustrates a directional sound playing system 100. The directional sound playing system 100 is configured to drive a plurality of ultrasonic sound sources. The plurality of ultrasonic sound sources can be installed on a surface of a supporting body 2.

In one exemplary embodiment, the plurality of ultrasonic sound sources comprises four ultrasonic sound sources, 1*a* to 1*d* for example, but this number is not limited by the exemplary embodiments herein. Each of the ultrasonic sound sources 1*a* to 1*d* comprises two ultrasonic loudspeakers. The two ultrasonic loudspeakers generate, modulate, and transmit two ultrasonic waves to a receiver 3 at the same time, to form an audible sound.

In one exemplary embodiment, the receiver 3 can be a human ear. The supporting body 2 can be a sphere structure, a cylindrical structure, or a cuboid structure.

Figure 2:
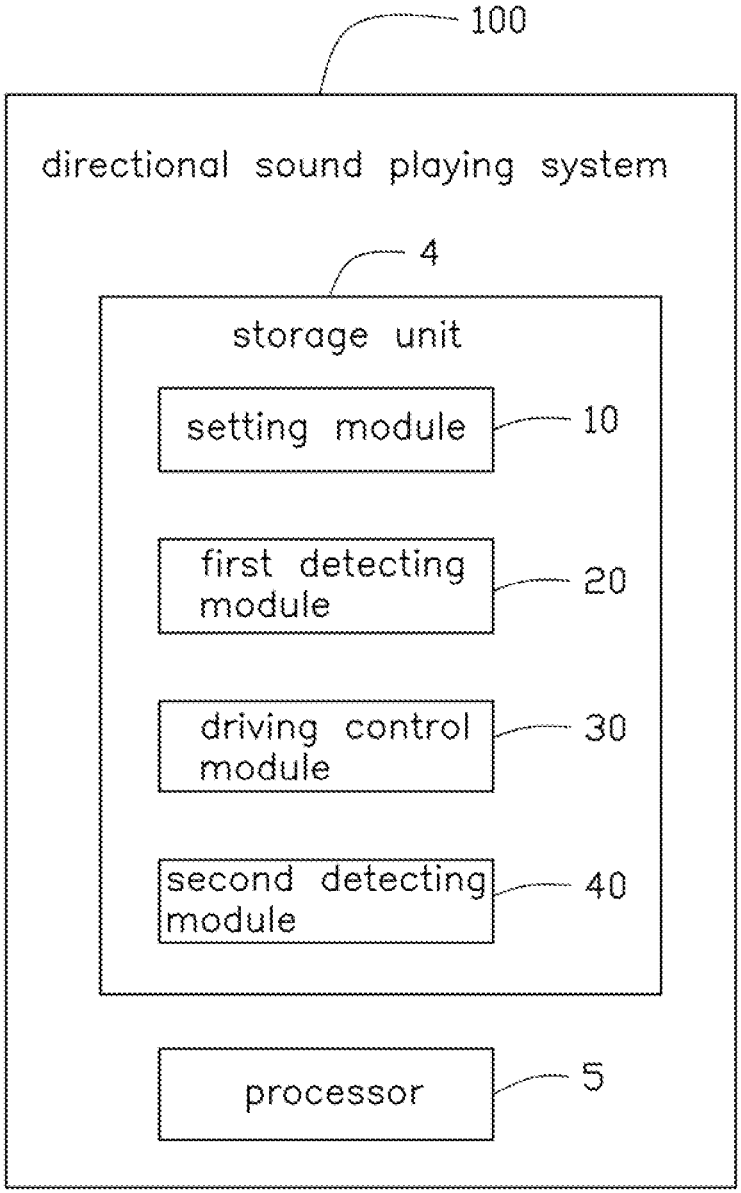
FIG. 2 is a block diagram of an exemplary embodiment of the directional sound playing system.

Referring to FIG. 2, the directional sound playing system 100 can comprise at least one storage unit 4 and at least one processor 5. The directional sound playing system 100 can further include a plurality of modules, such as a setting module 10, a first detecting module 20, a driving control module 30, and a second detecting module 40. The modules 10-40 can include one or more software programs in the form of computerized codes stored in the storage unit 4. The computerized codes can include instructions that can be executed by the processor 5 to provide functions for the modules 10-40.

The setting module 10 is configured to set an orientation for distribution by each of the ultrasonic sound sources 1*a* to 1*d* on the surface of the supporting body 2 according to a covering angle of each of the ultrasonic sound sources 1*a* to 1*d* and a requirement angle of the receiver 3.

In one exemplary embodiment, each of the ultrasonic sound sources 1*a* to 1*d* has the same covering angle. The requirement angle of the receiver 3 can be calculated according to a receiving range or a moving range of the receiver 3. For example, when the receiver 3 is stationary, the requirement angle of the receiver 3 can be calculated to target a central point 23 of the supporting body 2 (as a centre point) and the receiving range of the receiver 3. When the receiver 3 moves, the requirement angle of the receiver 3 can be calculated according to the central point 23 (as a centre point) and moving range of the receiver 3.

The covering angle of each of the ultrasonic sound sources 1*a* to 1*d* can be tapered. When the receiver 3 is not within a cover range of the ultrasonic sound sources 1*a* to 1*d*, the receiver 3 will not receive sound outputted by the ultrasonic sound sources 1*a* to 1*d*.

When the surface of the supporting body 2 has enough ultrasonic sound sources, the ultrasonic sound sources can be output through 360 degrees. Then, the receiver 3 can receive an ultrasonic sound from one or more ultrasonic sound sources no matter what angle the receiver 3 may be. A number of the ultrasonic sound sources can be estimated according to the covering angle of each of the ultrasonic sound sources.

In one exemplary embodiment, the larger the covering angle, the greater the number of the ultrasonic sound sources required.

When a possible moving range of the receiver 3 is a predetermined range, the requirement angle of the receiver 3 can be calculated according to the predetermined range. For example, if four ultrasonic sound sources 1*a* to 1*d* can meet the requirement angle of the receiver 3, the number of the ultrasonic sound sources installed on the surface of the supporting body 2 would be four.

Figure 3:
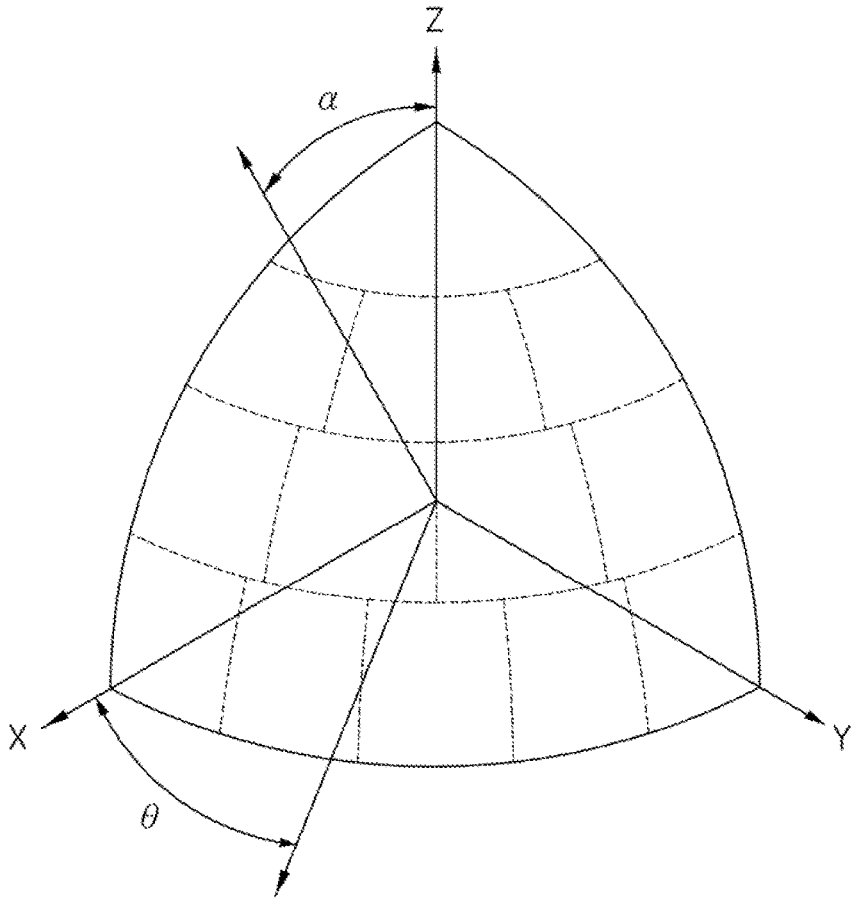
FIG. 3 is a diagram of angular coordinates of an ultrasonic sound source on a surface of a quarter sphere, in an exemplary embodiment.
Figure 4:
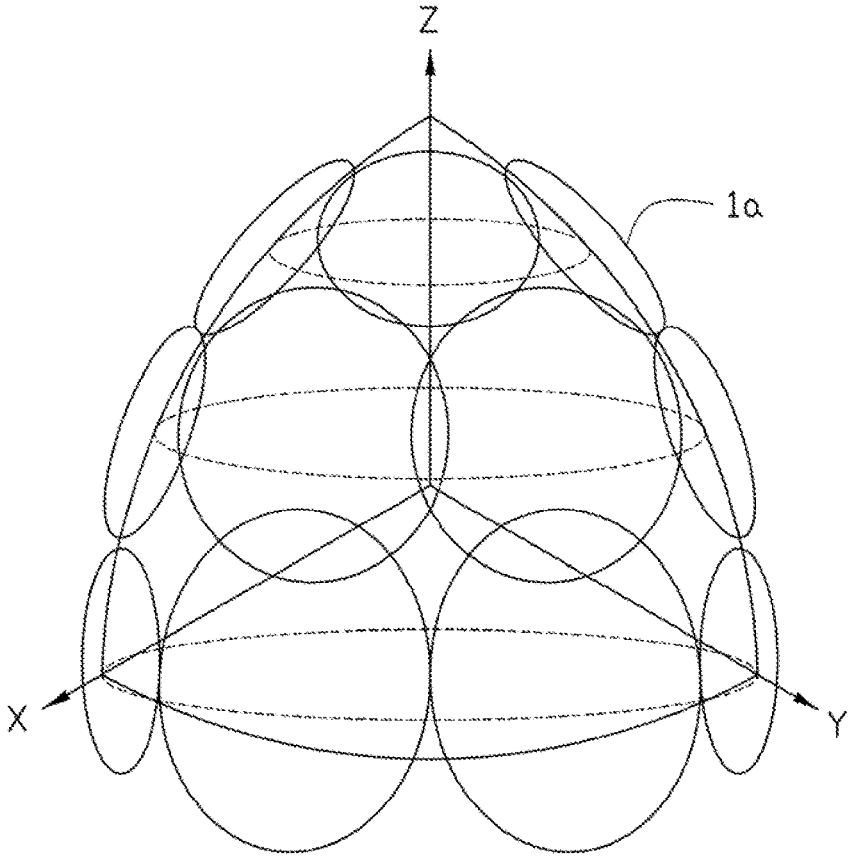
FIG. 4 is a position distribution diagram of an exemplary embodiment of a plurality of ultrasonic sound sources on the surface of the quarter sphere.

Referring to FIGS. 3-4, when the covering angles of the plurality of the ultrasonic sound sources form a sphere (that is, 360 degrees of output), the ultrasonic sound of the ultrasonic sound sources can be transmitted to the receiver 3 no matter what the angle of the receiver 3 may be. In FIGS. 3-4, the covering angles of the plurality of the ultrasonic sound sources form a quarter sphere for example. The covering angle of the ultrasonic sound sources 1*a* can taper at an angle of 30 degrees.

The setting module 10 sets multiple ultrasonic sound sources 1*a* on a surface of the quarter sphere to form a quarter sphere covering angle, and covering angles of two adjacent ultrasonic sound sources 1*a* are partially overlapping. A coordinate (α, θ) is configured to indicate a position of the ultrasonic sound source 1*a* that is installed on the surface of the quarter sphere. A first angle α is a ZX coordinates angle and a second angle θ is a XY coordinates angle. In the quarter sphere, the first angle α is greater than 0 degree and less than 90 degrees, and the second angle θ is greater than 0 degree and less than 90 degrees. According to FIG. 4, when the first angle α increases, the greater the number of the ultrasonic sound sources 1*a* to be installed on the surface of the quarter sphere.

In one exemplary embodiment, a first table as below shows distribution positions of multiple ultrasonic sound sources 1*a* on a surface of a hemisphere:

TABLE 1

| | θ | | | | | | | | |
|---|---|---|---|---|---|---|---|---|---|
| α | −90° | −60° | −45° | −30° | 0° | 30° | 45° | 60° | 90° |
| 0° | 01 | 00 | 00 | 00 | 01 | 00 | 00 | 00 | 01 |
| 15° | 01 | 00 | 00 | 00 | 01 | 00 | 00 | 00 | 01 |
| 30° | 01 | 00 | 01 | 00 | 01 | 00 | 01 | 00 | 01 |
| 45° | 01 | 01 | 00 | 01 | 01 | 01 | 00 | 01 | 01 |
| 60° | 01 | 01 | 00 | 01 | 01 | 01 | 00 | 01 | 01 |
| 75° | 01 | 01 | 00 | 01 | 01 | 01 | 00 | 01 | 01 |
| 90° | 01 | 01 | 00 | 01 | 01 | 01 | 00 | 01 | 01 |

In the hemisphere, the first angle α is greater than 0 degree and less than 90 degrees, and the second angle θ is greater than −90 degrees and less than 90 degrees. Digital 01 means setting an ultrasonic sound source 1*a* in coordinates of the hemisphere, and digital 00 means not setting an ultrasonic sound source 1*a* in coordinates of the hemisphere.

The first detecting module 20 is configured to obtain location information of the receiver 3. The location information of the receiver 3 is based on the supporting body 2 as a frame of reference.

In one exemplary embodiment, the first detecting module 20 can be a photographic device. The first detecting module 20 takes sample pictures of the receiver 3 in a predetermined frequency to calculate the location information of the receiver 3. For example, the first detecting module 20 takes sample pictures of the receiver 3 two times per second.

The driving control module 30 is configured to select and drive one or more ultrasonic sound sources to transmit ultrasonic sound to correspond to the location information of the receiver 3. The driving control module 30 determines the one or more ultrasonic sound sources that correspond to the location information of the receiver 3 according to the location information of the receiver 3 and the covering angle of each of the ultrasonic sound sources 1*a* to 1*d*.

For example, when the current location information of the receiver 3 is a location A, location A belongs to a cover range of ultrasonic sound source 1*a*. Then, the driving control module 30 drives the ultrasonic sound source 1*a* to transmit ultrasonic sound to the receiver 3. When the current location information of the receiver 3 is changed to a location B, location B belongs to a cover range of ultrasonic sound source 1*b*. Then, the driving control module 30 drives the ultrasonic sound source 1*b* to transmit ultrasonic sound to the receiver 3.

In one exemplary embodiment, the receiver 3 and the supporting body 2 can both move. In an initial state, the first detecting module 20 is further configured to obtain an initial displacement between the receiver 3 and a datum point 22 of the supporting body 2. In a moving state, the first detecting module 20 calculates a relative moving distance and a relative moving range between the receiver 3 and the datum point 22. The first detecting module 20 further calculates the location information of the receiver 3 according to the initial displacement, the relative moving distance, and the relative moving range.

In one exemplary embodiment, the supporting body 2 is a wearable device which is cylindrical. The ultrasonic sound sources 1*a* to 1*d* are installed on a surface of the wearable device. The supporting body 2 can be worn on an arm, and the receiver 3 can be ears of the wearer. The supporting body 2 comprises multiple sport modes. For example, the sport modes comprise a running mode, a brisk walking mode, and a riding mode. In each of the three sport modes, the arm has different movement ranges thus the supporting body 2 has different movement ranges.

The second detecting module 40 is configured to detect the sport mode of the supporting body 2 and update the location information of the receiver 3 at predetermined intervals. The driving control module 30 selects and drives one or more ultrasonic sound sources to transmit ultrasonic sound that correspond to the updated location information of the receiver 3.

Different sport modes correspond to different predetermined intervals. For example, in the running mode, the second detecting module 40 updates the location information of the receiver 3 three times per second. In the brisk walking mode, the second detecting module 40 updates the location information of the receiver 3 two times per second. In the riding mode, the second detecting module 40 updates the location information of the receiver 3 every two seconds.

The setting module 10 is further configured to convert the covering angles of each of the ultrasonic sound sources 1*a* to 1*d* according to the central point 23 of the supporting body 2. The setting module 10 is further configured to set the distribution position of each of the ultrasonic sound sources 1*a* to 1*d* on the surface of the supporting body 2 according to a converted covering angle of each of the ultrasonic sound sources 1*a* to 1*d* and the requirement angle of the receiver 3.

Figure 5:
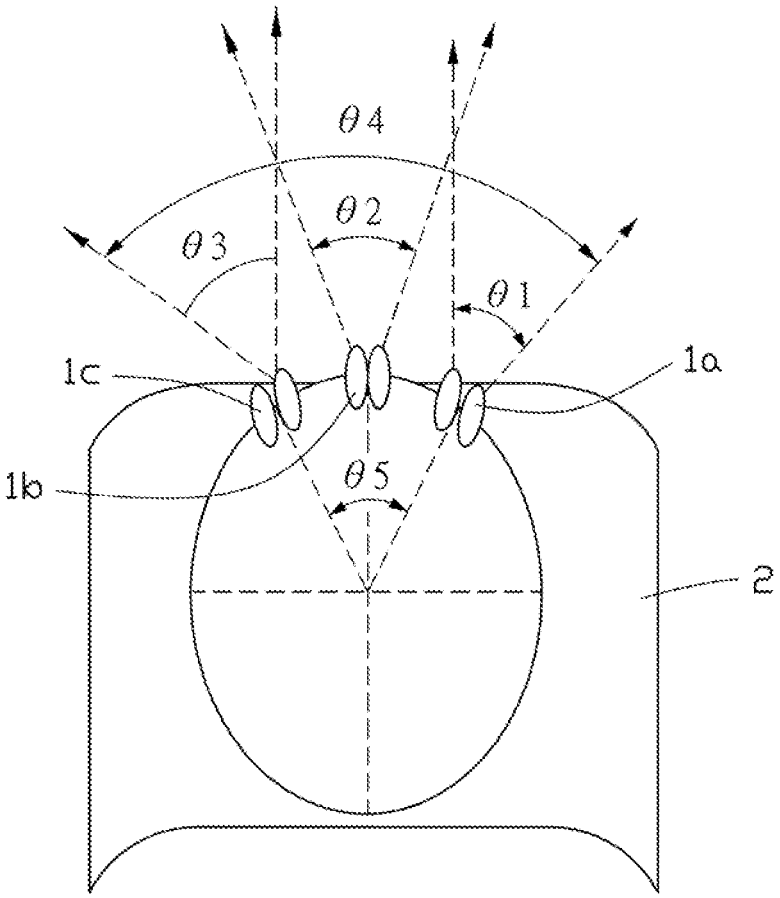
FIG. 5 is a position distribution diagram of an exemplary embodiment of a plurality of ultrasonic sound sources on a surface of a supporting body.

Referring to FIG. 5, for example, the covering angle of the ultrasonic sound source 1*a* is θ1, the covering angle of the ultrasonic sound source 1*b* is θ2, and the covering angle of the ultrasonic sound source 1*c* is θ3. The covering angles of the ultrasonic sound sources 1*a* to 1*c* partially overlap prevents blind or inaudible area. A total covering angle of the ultrasonic sound sources 1*a* to 1*c* is θ4, and a converted total covering angle of the ultrasonic sound sources 1*a* to 1*c* is θ5.

In one exemplary embodiment, the driving control module 30 further calculates a driving power and a gain according to the requirement angle of the receiver 3. The driving control module 30 drives the one or more ultrasonic sound sources to transmit ultrasonic sound that correspond to the location information of the receiver 3 according to a calculated driving power and a calculated gain.

Figure 6:
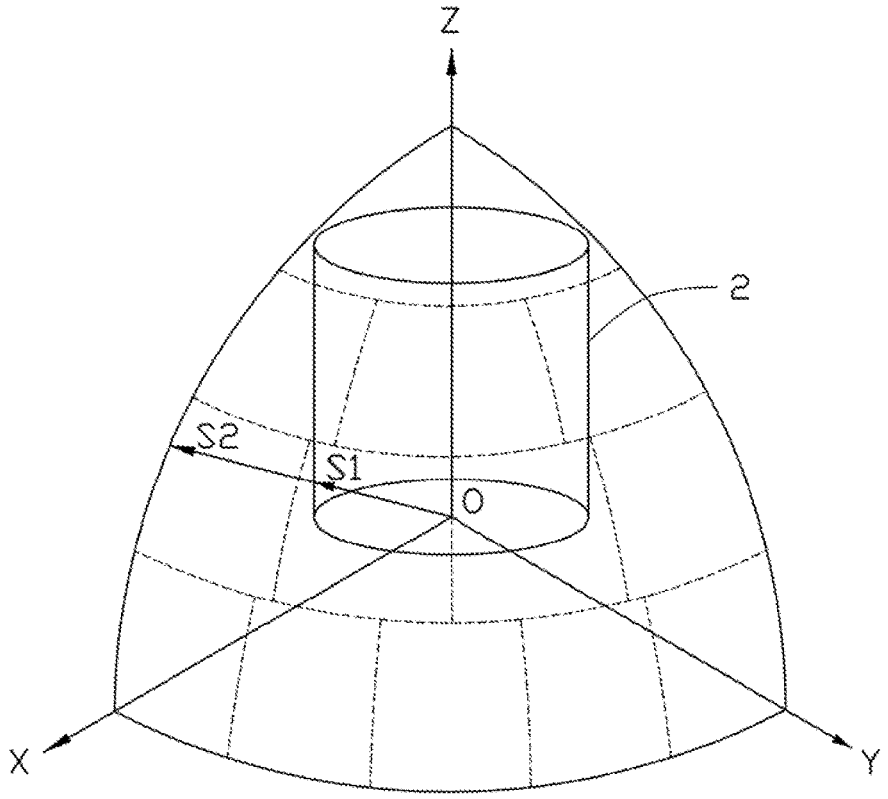
FIG. 6 is a diagram of vector transformations between the supporting body and the quarter sphere.
Figure 7:
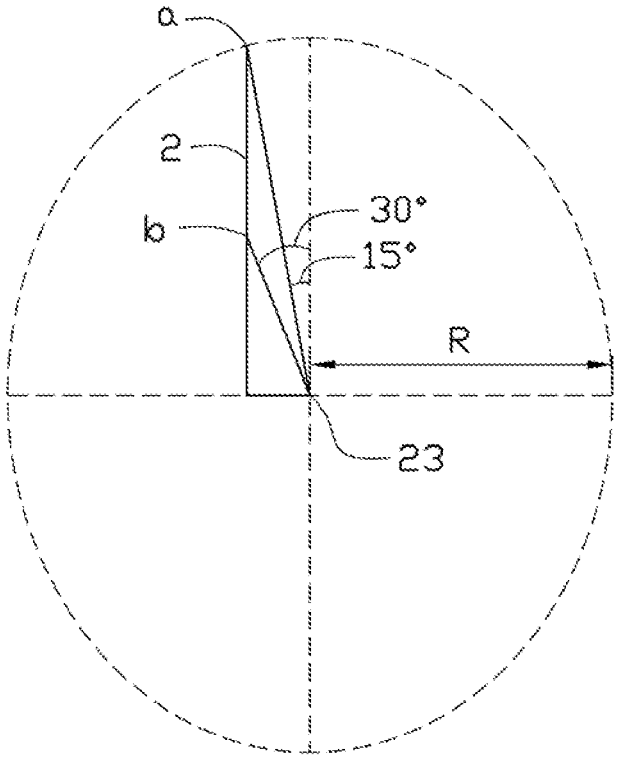
FIG. 7 is a diagram showing driving power calculation of the ultrasonic sound source.

Referring to FIGS. 6-7, for example, the supporting body 2 is a wearable device which is cylindrical, and the supporting body 2 can be worn on an arm. When the ultrasonic sound source 1*a* is mapped from a sphere to the cylindrical wearable device, a scaling factor f1 is applied between the sphere and the wearable device. A second vector quantity of the ultrasonic sound source 1*a* is S2 in the sphere (center O as a starting point). When the ultrasonic sound source 1*a* is mapped to the supporting body 2, the second vector quantity changes into a first vector quantity, and the first vector quantity is S1. A mathematical relationship between the first vector quantity and the second vector quantity is S1=f1*S2. A value of the scaling factor f1 is less than 1.

For example, the requirement angle of the receiver 3 is plus/minus 15 degrees, and the driving control module 30 calculates a first driving power of 1 watt. According to a gain calculating formula (20*log(driving power, 10)), the driving control module 30 calculates that a first gain of 0 db (20*log(1,10)=0).

When the requirement angle of the receiver 3 is plus/minus 30 degrees, the driving control module 30 calculates that a second driving power of 1.9 watt (R/0.518R=1.9), and the driving control module 30 calculates that a second gain of 5.7 db (20*log (1.9,10)=5.7).

In FIG. 7, a displacement between the central point 23 and a point a is R (R is a radius of the sphere). A displacement between the central point 23 and a point b is 0.518R. The point a is a node that has a 15 degrees requirement angle mapped in the supporting body 2. The point b is a node that has a 30 degrees requirement angle mapped in the supporting body 2.

When the requirement angle of the receiver 3 is plus/minus 45 degrees, plus/minus 60 degrees, plus/minus 75 degrees, or plus/minus 90 degrees, a calculating approach of the driving control module 30 is substantially the same as above.

In one exemplary embodiment, a second table as below shows values of the driving powers of different requirement angles:

TABLE 2

| | θ | | | | | | | | |
|---|---|---|---|---|---|---|---|---|---|
| α | −90° | −60° | −45° | −30° | 0° | 30° | 45° | 60° | 90° |
| 15° | 1.0 | null | null | null | 1.0 | null | null | null | 1.0 |
| 30° | 1.9 | null | 1.9 | null | 1.9 | null | 1.9 | null | 1.9 |
| 45° | 2.7 | 2.7 | null | 2.7 | 2.7 | 2.7 | null | 2.7 | 2.7 |
| 60° | 3.3 | 3.3 | null | 3.3 | 3.3 | 3.3 | null | 3.3 | 3.3 |
| 75° | 3.7 | 3.7 | null | 3.7 | 3.7 | 3.7 | null | 3.7 | 3.7 |
| 90° | 3.9 | 3.9 | null | 3.9 | 3.9 | 3.9 | null | 3.9 | 3.9 |

According to the Table 2, when the requirement angle of the receiver 3 is plus/minus 45 degrees, the driving control module 30 calculates that a third driving power of 2.7 watt. When the requirement angle of the receiver 3 is plus/minus 60 degrees, the driving control module 30 calculates a fourth driving power of 3.3 watt. When the requirement angle of the receiver 3 is plus/minus 75 degrees, the driving control module 30 calculates a fifth driving power of 3.7 watt. When the requirement angle of the receiver 3 is plus/minus 90 degrees, the driving control module 30 calculates a sixth driving power of 3.9 watt.

In one exemplary embodiment, a third table as below shows values of the gains of different requirement angles:

TABLE 3

| | θ | | | | | | | | |
|---|---|---|---|---|---|---|---|---|---|
| α | −90° | −60° | −45° | −30° | 0° | 30° | 45° | 60° | 90° |
| 15° | 0.0 | null | null | null | 0.0 | null | null | null | 0.0 |
| 30° | 5.7 | null | 5.7 | null | 5.7 | null | 5.7 | null | 5.7 |
| 45° | 8.7 | 8.7 | null | 8.7 | 8.7 | 8.7 | null | 8.7 | 8.7 |
| 60° | 10.5 | 10.5 | null | 10.5 | 10.5 | 10.5 | null | 10.5 | 10.5 |
| 75° | 11.4 | 11.4 | null | 11.4 | 11.4 | 11.4 | null | 11.4 | 11.4 |
| 90° | 11.7 | 11.7 | null | 11.7 | 11.7 | 11.7 | null | 11.7 | 11.7 |

According to the Table 3, when the requirement angle of the receiver 3 is plus/minus 45 degrees, the driving control module 30 calculates a third gain of 8.7 db. When the requirement angle of the receiver 3 is plus/minus 60 degrees, the driving control module 30 calculates a fourth gain of 10.5 db. When the requirement angle of the receiver 3 is plus/minus 75 degrees, the driving control module 30 calculates a fifth gain of 11.4 db. When the requirement angle of the receiver 3 is plus/minus 90 degrees, the driving control module 30 calculates a sixth gain of 11.7 db.

Figure 8:
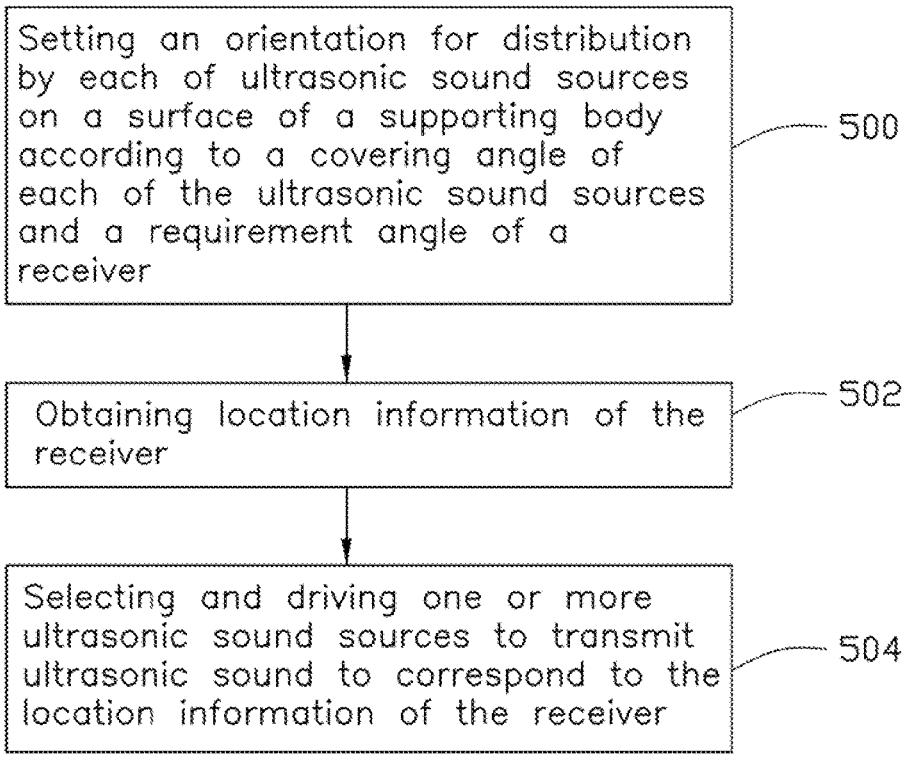
FIG. 8 is a flow diagram of an exemplary embodiment of a directional sound playing method.

FIG. 8 illustrates an exemplary embodiment of a method for directional sound playing. The example method is provided by way of example, as there are a variety of ways to carry out the method. The method described below can be carried out using the configurations illustrated in FIG. 2, for example, and various elements of these figures are referenced in explaining the example method. Each step shown in FIG. 8 represents one or more processes, methods, or subroutines, carried out in the example method. Furthermore, the illustrated order of steps is illustrative only and the order of the steps can change. Additional steps can be added or fewer steps may be utilized without departing from this disclosure. The example method can begin at step 500.

In step 500, the setting module 10 sets an orientation for distribution by each of the ultrasonic sound sources 1*a* to 1*d* on the surface of the supporting body 2 according to a covering angle of each of the ultrasonic sound sources 1*a* to 1*d* and a requirement angle of the receiver 3.

In step 502, the first detecting module 20 obtains location information of the receiver 3.

In step 504, the driving control module 30 selects and drives one or more ultrasonic sound sources to transmit ultrasonic sound to correspond to the location information of the receiver 3.

In one exemplary embodiment, the setting module 10 further converts the covering angles of each of the ultrasonic sound sources 1*a* to 1*d* according to the central point 23. The setting module 10 sets the distribution position of each of the ultrasonic sound sources 1*a* to 1*d* on the surface of the supporting body 2 according to the converted covering angle of each of the ultrasonic sound sources 1*a* to 1*d* and the requirement angle of the receiver 3.

In one exemplary embodiment, the location information of the receiver 3 is based on the supporting body 2 as the frame of reference. When the receiver 3 and the supporting body 2 can both move, the first detecting module 20 is further configured to obtain the initial displacement between the receiver 3 and the datum point 22. In the moving state, the first detecting module 20 calculates the relative moving distance and the relative moving range between the receiver 3 and the datum point 22. The first detecting module 20 further calculates the location information of the receiver 3 according to the initial displacement, the relative moving distance, and the relative moving range.

In one exemplary embodiment, the driving control module 30 determines the one or more ultrasonic sound sources to correspond to the location information of the receiver 3 according to the location information of the receiver 3 and the covering angle of each of the ultrasonic sound sources 1*a* to 1*d*.

In one exemplary embodiment, the supporting body 2 comprises multiple sport modes. The second detecting module 40 detects the sport mode of the supporting body 2 and updates the location information of the receiver 3 in a predetermine time. The driving control module 30 selects and drives one or more ultrasonic sound sources to transmit ultrasonic sound that are corresponding to the updated location information of the receiver 3.

In one exemplary embodiment, the driving control module 30 further calculates the driving power and the gain according to the requirement angle of the receiver 3. The driving control module 30 drives the one or more ultrasonic sound sources to transmit ultrasonic sound according to the calculated driving power and the calculated gain.

The exemplary embodiments shown and described above are only examples. Many such details are neither shown nor described. Even though numerous characteristics and advantages of the present technology have been set forth in the foregoing description, together with details of the structure and function of the present disclosure, the disclosure is illustrative only, and changes may be made in the detail, including in matters of shape, size, and arrangement of the parts within the principles of the present disclosure, up to and including the full extent established by the broad general meaning of the terms used in the claims. It will therefore be appreciated that the exemplary embodiments described above may be modified within the scope of the claims.

What is claimed is:

1. A directional sound playing method comprising:

calculating a requirement angle of a receiver by a driving control module, wherein the requirement angle of the receiver is calculated to target a central point of a supporting body and a receiving range of the receiver when the receiver is stationary, and the requirement angle of the receiver is calculated according to the central point and a moving range of the receiver when the receiver moves;

setting an orientation for distribution by each of a plurality of ultrasonic sound sources on a surface of the supporting body by a setting module according to a covering angle of each of the ultrasonic sound sources and the requirement angle of the receiver;

obtaining location information of the receiver by a first detecting module; and selecting and driving one or more ultrasonic sound sources to transmit ultrasonic sound to correspond to the location information of the receiver by the driving control module.

2. The directional sound playing method of claim 1, wherein the location information of the receiver is based on the supporting body as a frame of reference.

3. The directional sound playing method of claim 1, wherein the supporting body is a cylindrical structure; and the step of setting the orientation for distribution by each of the ultrasonic sound sources comprises:

converting the covering angle of each of the ultrasonic sound sources according to the central point of the supporting body by the setting module to generate a converted covering angle; and setting the orientation for distribution by each of the ultrasonic sound sources on the surface of the supporting body by the setting module according to the converted covering angle of each of the ultrasonic sound sources and the requirement angle of the receiver.

4. The directional sound playing method of claim 1, wherein the step of obtaining the location information of the receiver comprises:

obtaining an initial displacement between the receiver and a datum point of the supporting body by the first detecting module;

calculating a relative moving distance and a relative moving range between the receiver and the datum point of the supporting body by the driving control module; and obtaining the location information of the receiver by the first detecting module according to the initial displacement, the relative moving distance, and the relative moving range.

5. The directional sound playing method of claim 4, further comprising:

detecting a sport mode of the supporting body by a second detecting module; and updating the location information of the receiver at a predetermined interval by the second detecting module;

wherein different sport modes correspond to different predetermined intervals.

6. The directional sound playing method of claim 1, wherein the step of selecting and driving one or more ultrasonic sound sources to transmit ultrasonic sound to correspond to the location information of the receiver comprises:

selecting one or more ultrasonic sound sources according to the location information of the receiver and the covering angle of each of the ultrasonic sound sources by the driving control module; and driving selected ultrasonic sound sources to transmit ultrasonic sound to the receiver by the driving control module.

7. The directional sound playing method of claim 1, wherein the step of selecting and driving one or more ultrasonic sound sources to transmit ultrasonic sound to correspond to the location information of the receiver comprises:

selecting one or more ultrasonic sound sources to correspond to the location information of the receiver by the driving control module;

calculating a driving power and a gain according to the requirement angle of the receiver by the driving control module; and driving the one or more ultrasonic sound sources to transmit ultrasonic sound according to a calculated driving power and a calculated gain by the driving control module.

8. A directional sound playing system for driving a plurality of ultrasonic sound sources, the plurality of ultrasonic sound sources installed on a surface of a supporting body, the directional sound playing system comprising:

at least one storage unit, configured to store a plurality of modules, being a collection of instructions of an application operable in the system;

at least one processor, configured to execute the plurality of modules, the modules comprising:

a setting module, configured to set an orientation for distribution by each of the ultrasonic sound sources on the surface of the supporting body according to a covering angle of each of the ultrasonic sound sources and a requirement angle of a receiver;

a first detecting module, configured to obtain location information of the receiver; and a driving control module, configured to select and drive one or more ultrasonic sound sources to transmit ultrasonic sound that to correspond to the location information of the receiver;

wherein the requirement angle of the receiver is calculated to target a central point of the supporting body and a receiving range of the receiver when the receiver is stationary, and the requirement angle of the receiver is calculated according to the central point and a moving range of the receiver when the receiver moves.

9. The directional sound playing system of claim 8, wherein the location information of the receiver is based on the supporting body as a frame of reference.

10. The directional sound playing system of claim 8, wherein the supporting body is a cylindrical structure; and the setting module is further configured to convert the covering angle of each of the ultrasonic sound sources according to the central point of the supporting body to generate a converted covering angle, and set the orientation for distribution by each of the ultrasonic sound sources on the surface of the supporting body according to the converted covering angle of each of the ultrasonic sound sources and the requirement angle of the receiver.

11. The directional sound playing system of claim 8, wherein the first detecting module is further configured to obtain an initial displacement between the receiver and a datum point of the supporting body, calculate a relative moving distance and a relative moving range between the receiver and the datum point, and obtain the location information of the receiver according to the initial displacement, the relative moving distance, and the relative moving range.

12. The directional sound playing system of claim 11, further comprising a second detecting module, wherein the supporting body comprises multiple sport modes; and the second detecting module is configured to detect a sport mode of the supporting body and update the location information of the receiver at a predetermined interval corresponding to the sport mode of the supporting body.

13. The directional sound playing system of claim 12, wherein different sport modes correspond to different predetermined intervals.

14. The directional sound playing system of claim 8, wherein the driving control module is further configured to select the one or more ultrasonic sound sources according to the location information of the receiver and the covering angle of each of the ultrasonic sound sources, and drive selected ultrasonic sound sources to transmit ultrasonic sound to the receiver.

15. The directional sound playing system of claim 8, wherein the driving control module is further configured to calculate a driving power and a gain according to the requirement angle of the receiver, and drive the one or more ultrasonic sound sources to transmit ultrasonic sound according to a calculated driving power and a calculated gain.

16. A directional sound playing system for driving a plurality of ultrasonic sound sources, the plurality of ultrasonic sound sources installed on a surface of a supporting body, the directional sound playing system comprising:

at least one storage unit, configured to store a plurality of modules, being a collection of instructions of an application operable in the system;

at least one processor, configured to execute the plurality of modules, the modules comprising:

a setting module, configured to set an orientation for distribution by each of the ultrasonic sound sources on the surface of the supporting body according to a covering angle of each of the ultrasonic sound sources and a requirement angle of a receiver;

a first detecting module, configured to obtain location information of the receiver; and a driving control module, configured to select and drive one or more ultrasonic sound sources to transmit ultrasonic sound that to correspond to the location information of the receiver;

a second detecting module, wherein the supporting body comprises multiple sport modes; and the second detecting module is configured to detect a sport mode of the supporting body and update the location information of the receiver at a predetermined interval corresponding to the sport mode of the supporting body.

* * * * *